United States Patent [19]

Morman et al.

[11] 4,014,349

[45] Mar. 29, 1977

[54] SMOKING MATERIAL

[75] Inventors: James Forrester Morman; James Brown Parker, both of Manchester, England

[73] Assignee: Imperial Chemical Industries Limited, London, England

[22] Filed: Nov. 10, 1975

[21] Appl. No.: 630,429

Related U.S. Application Data

[63] Continuation of Ser. No. 386,428, Aug. 7, 1973, abandoned.

[30] Foreign Application Priority Data

Aug. 31, 1972 United Kingdom ..... 40324/72

[52] U.S. Cl. ..... 131/2

[51] Int. Cl.[2] ..... A24B 13/00; A24D 1/18

[58] Field of Search ..... 131/2, 140

[56] References Cited

UNITED STATES PATENTS

| | | | |
|---|---|---|---|
| 2,907,686 | 10/1959 | Siegel | 131/2 |
| 3,545,448 | 12/1970 | Mormon et al. | 131/2 |

OTHER PUBLICATIONS

*Wood Chemistry*, by Louis E. Wise, Reinhold Publishing Co., pp. 679–695 (1946).

*Primary Examiner*—Robert W. Michell
*Assistant Examiner*—Vincent Millin
*Attorney, Agent, or Firm*—Cushman, Darby & Cushman

[57] ABSTRACT

Manufacture of a smoking material by catalytic thermal degradation of carbohydrate material above 250° C, especially 250°–300° C, until the weight of solid residue is 50–90% (especially 65–90%) of the weight of original carbohydrate material, optionally bleaching, combining with a binder and fabricating to produce a tobacco simulating material.

8 Claims, 1 Drawing Figure

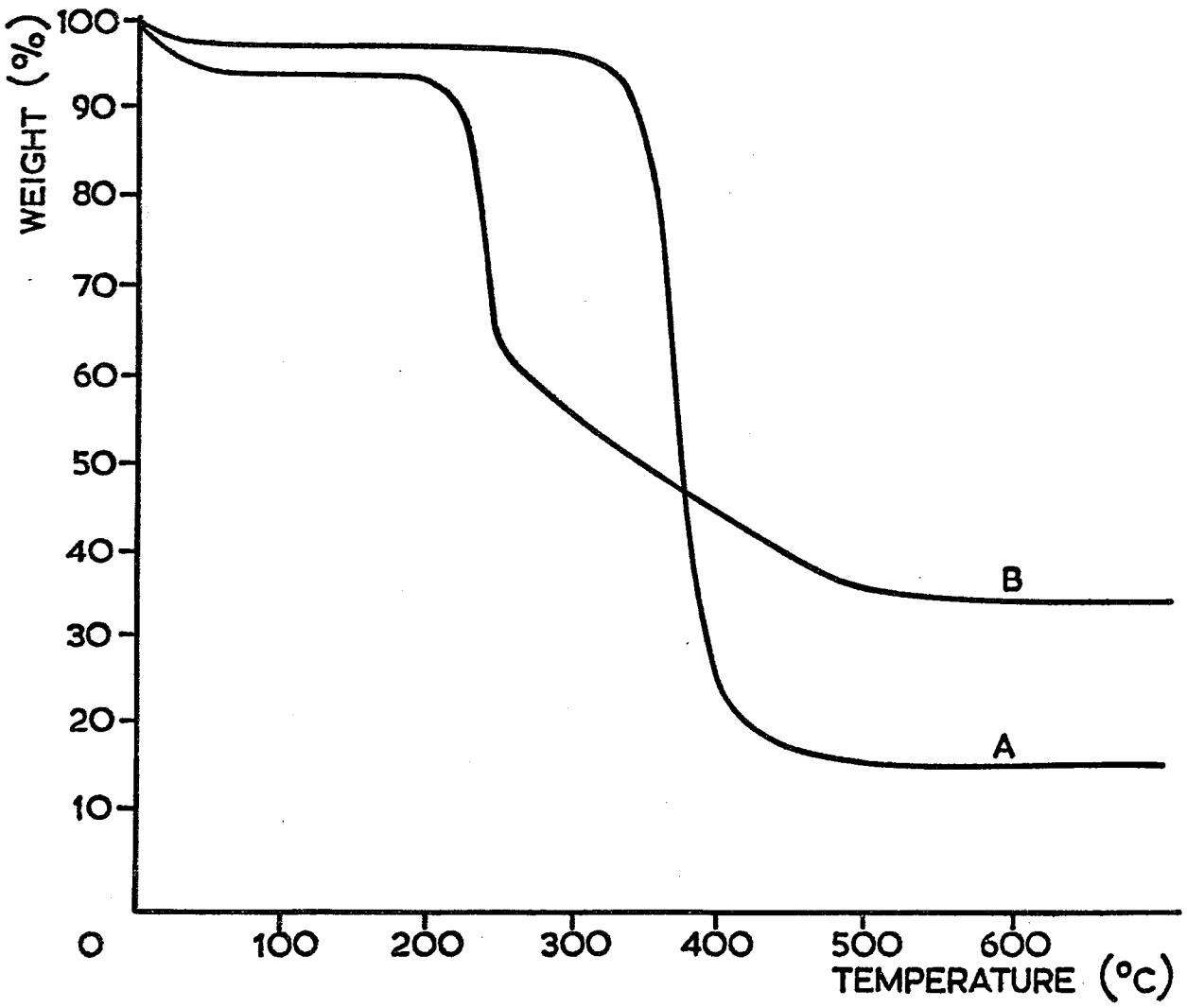
WEIGHT (%)
100
90
80
70
60
50
40
30
20
10
0
100
200
300
400
500
600
TEMPERATURE (°C)
A
B

SMOKING MATERIAL

This is a continuation of application Ser. No. 386,428, filed Aug. 7, 1973, now abandoned.

This invention relates to the manufacture of a smoking material for cigarettes, cigars, pipes and the like.

It is known that carbohydrates lose weight on heating, with the formation of simpler anhydro-sugars and/or the complete break up to small organic molecules such as acetaldehyde, formaldehyde formic acid, methane, carbon oxides, water and others. Cellulose in particular releases anhydroglucose units, particularly laevo glucosan.

Our British Patent No. 1,113,979 describes and claims a process for the preparation of a modified carbohydrate suitable for smoking mixtures which comprises subjecting carbohydrate to a catalysed degradation process at a temperature of 100° to 250° C until the weight of the degraded carbohydrate is less than 90% of the weight of the original carbohydrate. The degradation occurring in such a process is entirely different from that which occurs on heating a carbohydrate in the absence of a catalyst, and the products of the two processes are quite different.

It has hitherto been considered that if a carbohydrate was heated above 250° C, even in the presence of a catalyst, degradation would at least in part lead to the production of smaller molecules such as are obtained in the absence of any catalyst. This is not so, however, We have now found that degradation to anhydro-sugar and smaller units does not occur to any significant extent at all when a carbohydrate is heated in the presence of a catalyst, even at a temperature above 250° C.

In the accompanying drawings Curve A shows the weight loss achievable by heating $\alpha$-cellulose at increasing temperatures, and Curve B shows the weight loss achievable by heating $\alpha$-cellulose at the same temperatures in the presence of a catalyst (ammonium sulphamate, 5% by weight).

According to the present invention therefore we provide a process for the manufacture of a smoking material which comprises subjecting carbohydrate material to a catalysed thermal degradation at a temperature above 250° C, preferably 250° to 300° C, until the weight of the solid residue is from 50 to 90%, preferably 65 to 90%, of the weight of the original carbohydrate material, optionally bleaching the residue, combining it with a binder and fabricating to produce a tobacco-simulating material.

When operating at the relatively high temperatures used in the present process it is increasingly important to limit the duration of the heating in order that the weight of the residue does not fall below 50%, preferably 65% of the weight of the original carbohydrate material. The duration of the heating will depend very greatly upon the efficiency of the degradation catalyst employed. In general only short periods of heating will need to be employed, varying from a few minutes (e.g. about 5 minutes) at 250° C to only a few seconds at 300° C. The shorter heating times constitute a technical advantage over the process of our U.S. Pat. No. 1,113,979, enabling higher production rates of equally satisfactory material to be maintained in continuous operation. At the higher temperatures, for example above 270° C, it may be desirable to operate in the absence of oxygen.

The carbohydrate material used in the present process is preferably cellulose. Besides cellulose itself, other examples of carbohydrate material which may be used are cellulose derivatives such as methyl cellulose. Starch, e.g. rice, potato and maize starch, alginates, pectin, natural gums such as gum tragacanth, gum arabic and locust bean gum and simpler carbohydrates including mono- and di-saccharides for example glucose and sucrose are further examples of carbohydrate material which may be used.

Catalysts used in the thermal degradation step may be acidic or basic in nature, though preferably the former. Preferred catalysts are strong acids, and salts of strong acids with weak bases. Such catalysts include sulphamic acid, phosphoric acid, sulphuric acid, hydrochloric acid, perchloric acid, trichloroacetic acid, diammonium hydrogen phosphate, ammonium dihydrogen phosphate, ammonium sulphate, ferric chloride, zinc chloride, stannic chloride, aluminium chloride and especially ammonium sulphamate.

Basic catalysts include alkali hydroxides, e.g. sodium and potassium hydroxides, and alkali salts of weak acids, e.g. sodium and potassium carbonates, acetates and lactates.

To ensure that there is no substantial amount of degradation of the type represented by curve A in the accompanying drawings at least 1% by weight of catalyst should desirably be present, the preferred amount being from 2.5 to 20% by weight of the carbohydrate material.

Carbohydrate material may be subjected to the process of the invention in any convenient form, for example in powder or in sheet form. As for the process of U.S. Pat. No. 1,113,979 carbohydrate material in sheet form may first be impregnated with a solution of the catalyst applied by immersion or spraying, and dried; or powdered carbohydrate material may be mixed with a solution of the catalyst and dried.

Upon subjection to the process of the invention the carbohydrate material becomes degraded to a black material. Should the black colour be considered undesirable in smoking materials, however, the colour may be bleached to brown, resembling that of a cigarette tobacco, by treatment with nitric acid, ammonia or hydrogen peroxide, preferably at elevated temperature.

The thermally degraded carbohydrate material, optionally after bleaching is then fabricated into a form simulating tobacco, wiyth the aid of a binder. This step in the process may be carried out by the techniques described in British Patent No. 1,113,979. Thus for example the material may be comminuted to a powder, mixed with a solution of a binder, for example a water-soluble cellulose derivative e.g. methyl- or ethyl-cellulose, carboxymethyl cellulose or a salt thereof, starch, alginate, pectin, natural gums such as guar gum or locust bean gum, formed as a film and dried. Alternatively a mixture of the thermally degraded carbohydrate material and binder may be extruded as a filament or tape. The film, filament or tape may then be shredded to produce a tobacco-simulating material. Advantageously such material may be conditioned in a humid atmosphere to a mossture content of 5 to 15% by weight to make it more suitable for use as a filling for cigarettes or pipes.

Smoking materials manufactured by the process of the invention, like those prepared by the process of U.S. Pat. No. 1,113,979 are superior in smoke quality and taste to the corresponding smoking materials made from untreated carbohydrates and they give a smoother, less irritating smoke. The smoke which they produce contains less 'tar' than tobacco smoke. These smoking mixtures may also be varied more widely in composition, and consequently in smoke properties, than mixtures containing untreated carbohydrates, and even than mixtures containing only tobacco. For example, by the incorporation of tasting and flavouring additives, the taste and flavour of the smoke can be varied to suit a wider range of consumer preferences. The proportion of nicotine which is a desirable constituent of smoking mixtures, may also be adjusted widely as desired.

It will be understood that the smoking materials of the invention may comprise, in addition to the modified carbohydrate, other materials which are normal constituents of smoking materials such as, for example, tobacco, untreated carbohydrate or other smoke-producing organic material and, as desired, any of the other modifying agents commonly used in such mixtures. For example, the smoking materials may comprise glow-promoting catalysts, materials to improve ash coherence and colour, nicotine, flavourants or medicaments. Numerous beneficial flavouring materials may be included. These include tobacco extracts, organic esters, essential oils, menthol, tonka bean or vanillin. Glycerol and glycols, such as, for example, ethylene glycol and di-, tri- and tetra-ethylene glycol are convenient humectants.

If desired inorganic fillers may also be incorporated in the smoking materials of the invention. It is particularly beneficial to incorporate from 40 to 65% by weight of inorganic filler in such material, said filler being so chosen as to impart an acceptable combustion rate to the mixture as described in our British Patent No. 1,299,296. By this means the amount of harmful smoke ingredients reaching the smoker is still further reduced. Conveniently mixtures of calcium and magnesium carbonate may be used for this purpose.

The invention is illustrated but not limited by the following Examples in which the parts are by weight.

EXAMPLE 1

1.0 Part of sheeted $\alpha$-cellulose pulp was immersed in a 5% aqueous solution of ammonium sulphamate and the pulp pressed between rolls to leave 1 part of solution in the pulp. The pulp was dried and heat-treated for 100 seconds at 270° C. This process made the pulp black. The weight of degraded material was 75% of the original weight of $\alpha$-cellulose and ammonium sulphamate. The degraded material was then made into film and cigarettes as described in Example 12 of British Patent No. 1,113,979.

The sidestream and mainstream smokes produced from the cigarettes were milder and less irritating to the eyes and throat than those from an ordinary tobacco cigarette.

EXAMPLE 2

1.0 part of $\alpha$-cellulose pulp was impregnated with 7.0% aqueous solution of ammonium sulphamate and compressed to leave one part of solution in the cellulose. The cellulose was dried at 165° C and then heated with air at 265° C for 2 minutes until the weight of material was 73% of the original weight and the colour changed to black.

26.9 parts of the black material were mixed with 6.7 parts of glycerol, 9.6 parts of sodium carboxymethyl cellulose, 21.3 parts of calcium carbonate and 35.5 parts of magnesite and the mixture processed to make a film as described in Example 6 of our British Patent No. 1,299,296. The film was shredded and made into cigarettes. The sidestream and mainstream smoke were milder and less irritating to the eyes and throat than that of an ordinary tobacco cigarette.

When the black material of the heating process was pyrolysed in a standard fashion at 600° C and the pyrolysis products swept on to a gas chromatogram, the yields of acetaldehyde and acrolein, two particularly irritant species, were substantially lower than the yields from the parent cellulose. Comparative yields in arbitrary units (peak heights on the recorder traces) of acetaldehyde and acrolein were:

| | Acetaldehyde | Acrolein |
|---|---|---|
| Cellulose | More than 250 | 148 |
| Example 2 product | 80 | 45 |

A similar black material was produced when Example 2 was repeated at 300° C for 1½ minutes instead of 165° C for 2 minutes.

EXAMPLE 3

The process described in Example 2 was repeated except that the aqueous solution contained sulphuric acid. The air temperature was 280° C, heating time was 1½ minutes and weight of material was 75%.

Cigarettes were again less irritating to eyes and throat.

Comparative yields of acetaldehyde and acrolein were:

| | Acetaldehyde | Acrolein |
|---|---|---|
| Cellulose | More than 250 | 148 |
| Example 3 product | 95 | 40 |

EXAMPLE 4

The process described in Example 2 was repeated except that the aqueous solution contained sodium hydroxide. The air temperature was 275° C, heating time was 3 minutes and the weight of material was 80% of the original weight.

Cigarettes were again less irritating to eyes and throat.

Comparative yields of acetaldehyde and acrolein on 600° C pyrolysis were:

| | Acetaldehyde | Acrolein |
|---|---|---|
| Cellulose | More than 250 | 148 |
| Example 4 product | 130 | 41 |

EXAMPLE 5

The process described in Example 2 was repeated except that the aqueous solution contained 10% sodium carbonate. The air temperature was 270°, heating time was 4 minutes and weight of the residual material was 70% of the original weight of cellulose.

Cigarettes were again less irritating to eyes and throat.

Comparative yields of acetaldehyde and acrolein on 600° C pyrolysis were:

| | Acetaldehyde | Acrolein |
|---|---|---|
| Cellulose | 250 | 148 |
| Example 5 product | 125 | 40 |

EXAMPLE 6

20 parts of sucrose were mixed with 20 parts of 10% aqueous solution of ammonium sulphamate. The resulting wet paste was dried at 60° C and then heated with air at 280° C for 5 minutes when weight of material was 71% that of original weight of sucrose.

Cigarettes were prepared as described in Example 2 and were again less irritating to eyes and throat.

Comparative yields of the irritant species acetaldehyde and acrolein on 600° C pyrolysis were:

| | Acetaldehyde | Acrolein |
|---|---|---|
| Sucrose | More than 250 | 160 |
| Example 6 product | 110 | 47 |

EXAMPLE 7

The process described in Example 6 was repeated except that the carbohydrate was glucose. The temperature of the heated air was 280° C, heating time was 5 minutes and weight was 73% that of the original weight of glucose.

Cigarettes were less irritating to nose and throat.

Comparative yields of acetaldehyde and acrolein on 600° C pyrolysis were:

| | Acetaldehyde | Acrolein |
|---|---|---|
| Glucose | More than 250 | 150 |
| Example 7 product | 100 | 45 |

EXAMPLE 8

The process described in Example 6 was repeated except that carbohydrate was starch. The temperature of the heated air was 275° C, heating time was 5 minutes and the weight was 75% that of the original weight of starch.

Cigarettes were less irritating to nose and throat.

Comparative yields of acetaldehyde and acrolein on 600° C pyrolysis were:

| | Acetaldehyde | Acrolein |
|---|---|---|
| Starch | More than 250 | 155 |
| Example 8 product | 95 | 40 |

We claim:

1. In a process for the production of a tobacco substitute wherein a carbohydrate is subjected to catalytic thermal degradation in the presence of a non-toxic catalyst selected from the group consisting of a strong acid, a salt of a strong acid and a weak base, an alkali hydroxide or an alkali salt of a weak acid, the modification which comprises carrying out the degradation at a temperature significantly in excess of 250° up to 300° C until the weight of the residue is from 65 to 90% of the weight of the original carbohydrate and recovering said residue so as to avoid significant formation of anhydrosugar and smaller organic molecules.

2. Process according to claim 1 wherein the carbohydrate material is cellulose.

3. Process according to claim 1 wherein the carbohydrate material is starch.

4. Process according to claim 1 wherein the catalyst employed is ammonium sulphamate.

5. Process according to claim 1 wherein carbohydrate material in sheet or powder form is first impregnated with a solution of catalyst and dried.

6. A process according to claim 1 wherein said carbohydrate is in sheet form and is first impregnated with a solution of catalyst and dried before said catalytic degredation.

7. Process according to claim 1 wherein the recovered residue is fabricated to produce a tobacco-simulating material.

8. Process according to claim 1 wherein the recovered residue is combined with a binder and fabricated into a sheet.

* * * * *